US006003532A

United States Patent [19]

Pi

[11] Patent Number: 6,003,532

[45] Date of Patent: Dec. 21, 1999

[54] WHEELED TRIPLE-LEG WALKER

[76] Inventor: Ching-Tien Pi, 3F, No. 36, Lane 105, Sec. 1, Pei Yi Rd., Hsin Tien City, Taipei, Taiwan

[21] Appl. No.: 09/060,246

[22] Filed: Apr. 15, 1998

[51] Int. Cl.[6] ..... A61H 3/04

[52] U.S. Cl. ..... 135/67; 135/74; 135/77; 135/84; 135/85

[58] Field of Search ..... 135/65, 67, 79, 135/77, 84–85

[56] References Cited

U.S. PATENT DOCUMENTS

| | | | |
|---|---|---|---|
| 4,159,110 | 6/1979 | Dodenhoff | 135/67 |
| 4,510,956 | 4/1985 | King | 135/67 |
| 4,962,781 | 10/1990 | Kanbar | 135/65 |
| 5,133,377 | 7/1992 | Truxillo | 135/67 |
| 5,378,215 | 1/1995 | Harkins | 135/67 |

*Primary Examiner*—Beth Aubrey
*Attorney, Agent, or Firm*—Rosenberg, Klein & Lee

[57] ABSTRACT

A wheeled triple-leg walker includes an upright tube, two F-shaped armrest frames respectively turned about the upright tube, a stretcher bar having a first end pivoted to one armrest frame and a second end adjustably connected to the other armrest frame to maintain the contained angle defined between the armrest frames, three wheel assemblies respectively mounted on the armrest frames and the upright tube at a bottom side for supporting and moving the wheeled triple-leg walker on the ground, and two armrest pads respectively mounted on the armrest frames at a top side for supporting the user's forearms when the user moves the wheeled triple-leg walker and walks.

21 Claims, 11 Drawing Sheets

WHEELED TRIPLE-LEG WALKER

BACKGROUND OF THE INVENTION

The present invention relates to walkers, and more particularly to a wheeled triple-leg walker that is folding collapsible, and stable in use.

Various walkers have been disclosed for use to help aged or disabled persons to walk and have appeared on the market. Various walking aids are known in which bubular elements are assembled in frame structures which can support the user in the armpit, similar to crutches. A number of similar wheeled structures has been suggested in various patents. However, for various reasons these have not become commercially acceptable, probable because of the complicated, and possibly expensive design. Such patents include U.S. Pat. Nos. 4,159,110; 4,510,956; 5,378,215; 4,962,781 and 5,133,377. These conventional walkers may be equipped or not equipped with wheels. However, these conventional walkers are still not satisfactory in function. The drawbacks of these conventional walkers are outlined hereinafter.

1. These conventional walkers are unstable when moving over an uneven road surface.
2. Because the user must lift the walker from the ground fore stepping forwards, the user cannot walk for long.
3. The walker may fall to the ground when user tilts the body and steps forwards, because the weight of the body of the user is supported on the area grasped by the user's hands when stepping forwards.
4. The swivel wheels tend to be forced to change the steering direction when moved over an uneven road surface, thereby causing the user unable to positively control the moving direction of the wheeled walker.
5. These conventional walkers are commonly complicated and expensive.

SUMMARY OF THE INVENTION

The present invention has been accomplished to provide a wheeled triple-leg walker which eliminates the aforesaid drawbacks. According to one aspect of the present invention, the wheeled triple-leg walker has three legs arranged in three comers and equipped with a respective wheel assembly for moving on the ground stably. According to another aspect of the present invention, the frame structure of the wheeled triple-leg walker is folding collapsible. According to still another aspect of the present invention, the wheeled triple-leg walker comprises two armrest pads bilaterally disposed at the top for supporting the forearms when the user moves the wheeled triple-leg walker and walks. According to still another aspect of the present invention, each wheel assembly comprises a swivel wheel holder holding a wheel, and a constraint spring plate which stops the swivel wheel holder from biasing, the swivel wheel holder being allowed to be turned about the respective leg when a downward pressure is applied to the constraint spring plate through the respective leg. According to still another aspect of the present invention, a detachable seat is provided for the user to sit thereon when taking a rest.

DETAILED DESCRIPTION OF THE PREFERRED EMBODIMENT

Figure 1:
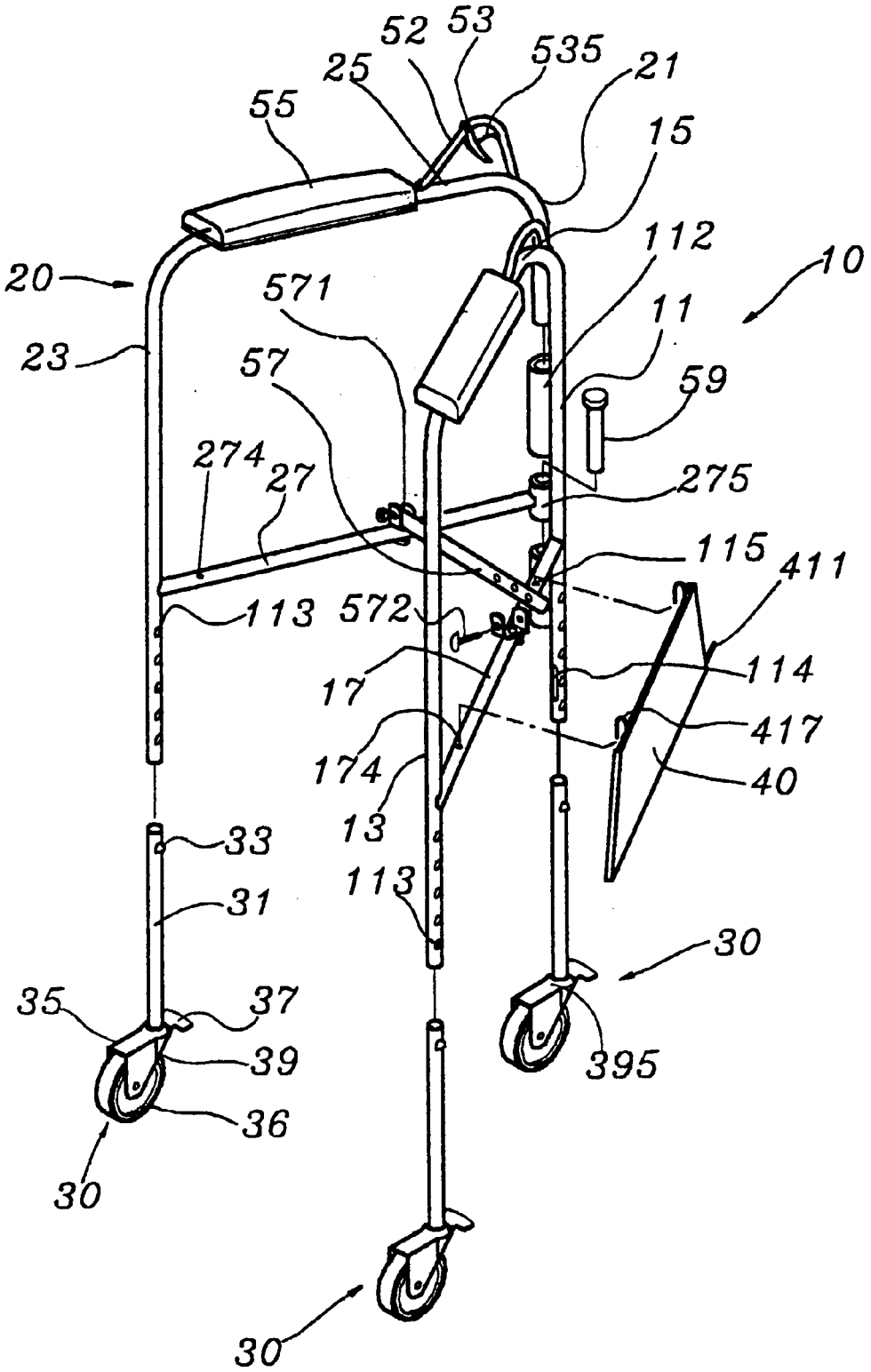
FIG. 1 is an exploded view of a wheeled triple-leg walker according to a first embodiment of the present invention.
Figures 2, 2A:
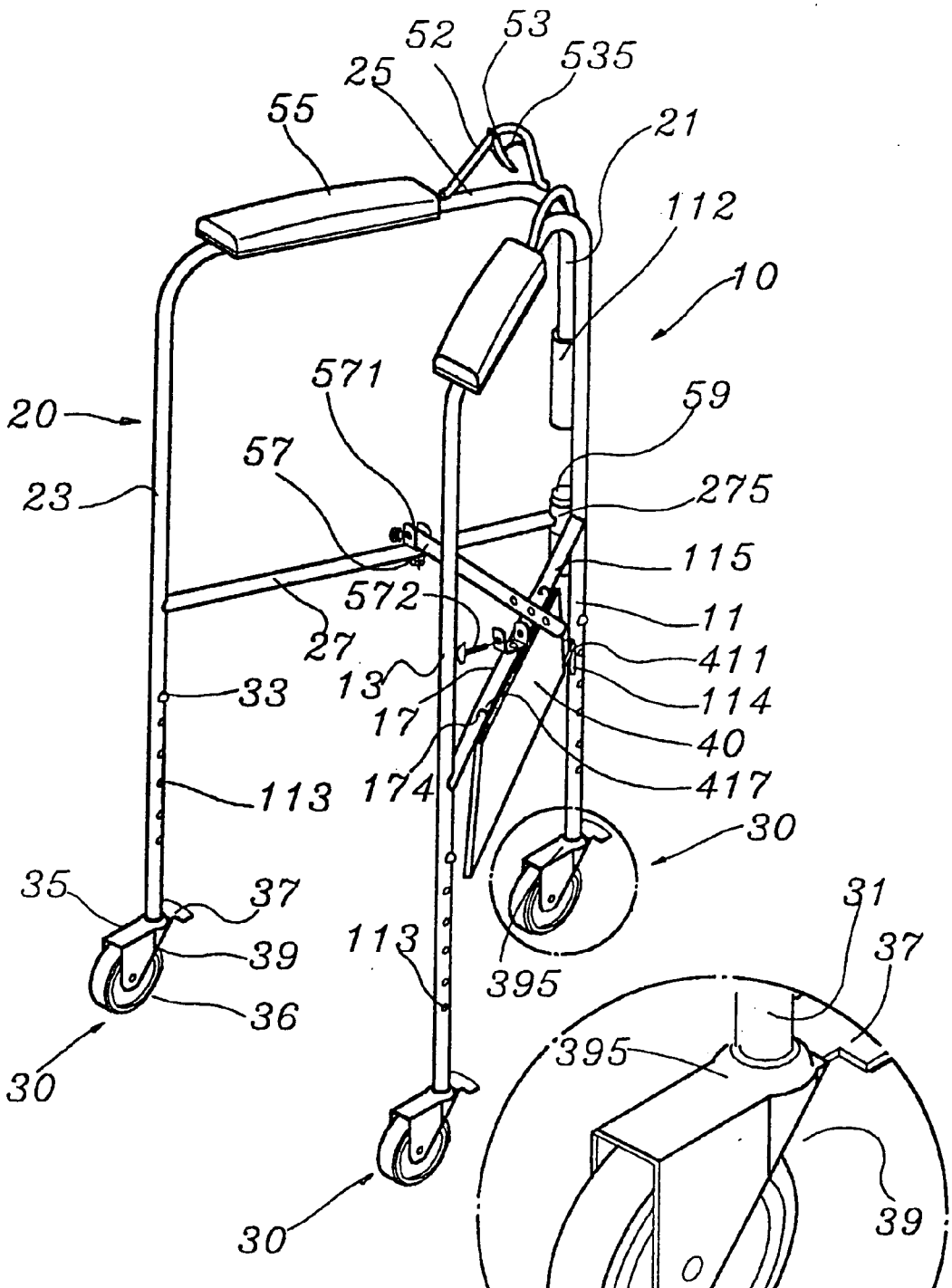
FIG. 2 is a perspective view of the first embodiment of the present invention, showing the wheeled triple-leg walker set in an operative condition.
FIG. 2A is an enlarged view of a part of FIG. 2, showing the structure of the wheel assembly.

Referring to FIGS. 1 and 2, a wheeled triple-leg walker according to a first embodiment of the present invention is shown comprised of a first U-shaped armrest frame 10, a second U-shaped armrest frame 20, three wheel assemblies 30, a seat 40, and two armrest pads 55.

The first armrest frame 10 comprises a horizontal top tube 15, a first downwardly extended vertical tube 11 and a second downwardly extended vertical tube 13 respectively integral with both ends of the horizontal top tube 15, and a barrel 112 integral with the periphery of the first downwardly extended vertical tube 11 at a suitable location. The second armrest frame 20 comprises a horizontal top tube 25, a first downwardly extended vertical tube 21 and a second downwardly extended vertical tube 23 respectively integral with both ends of the horizontal top tube 25. The downwardly extended vertical tubes 11;13 of the first armrest frame 10 and the second downwardly extended vertical tube 23 of the second armrest frame 20 are equal in length. The first downwardly extended vertical tube 21 of the second armrest frame 20 is relatively shorter then the downwardly extended vertical tubes 11;13 of the first armrest frame 10 and the second downwardly extended vertical tube 23 of the second armrest frame 20. The first armrest frame 10 and the second armrest frame 20 are fastened together by fitting the first downwardly extended vertical tube 21 of the second armrest frame 20 into the barrel 112 at the first downwardly extended vertical tube 11 of the first armrest frame 10. When coupled, the first armrest frame 10 and the second armrest frame 20 can be turned horizontally inwards and outwards relative to each other, i.e., the contained angle between the first armrest frame 10 and the second armrest frame 20 can be adjusted as desired. Vertically spaced pin holes 113 are respectively provided at the downwardly extended vertical tubes 11;13 of the first armrest frame 10 and the second downwardly extended vertical tube 23 of the second armrest frame 20. The three wheel assemblies 30 are respectively fastened to the downwardly extended vertical tubes 11;13 of the first armrest frame 10 and the second downwardly extended vertical tube 23 of the second armrest frame 20.

Each wheel assembly 30 comprises a leg 31 which is inserted into one of the downwardly extended vertical tubes 11;13 of the first armrest frame 10 and the second downwardly extended vertical tube 23 of the second armrest frame 20 and secured to one of the corresponding vertically spaced pin holes 113 by a respective pin 33, a wheel holder 39 coupled to the bottom end of the leg 31, and a wheel 36 revolvably supported on the wheel holder 39. The armrest pads 55 are respectively fastened to the horizontal top tubes 15;25.

In order to reinforce the structure strength of the first armrest frame 10 and the second armrest frame 20, a first cross bar 17 is connected between the downwardly extended vertical tubes 11;13 of the first armrest frame 10, and a second cross bar 27 is connected between the first downwardly extended vertical tube 11 of the first armrest frame 10 and the second downwardly extended vertical tube 23 of the second armrest frame 20. The second cross bar 27 has one end fixedly connected to the second downwardly extended vertical tube 23 of the second armrest frame 20, and an opposite end terminating in a vertical barrel 275, which is connected to a vertical barrel 115 at the first downwardly extended vertical tube 11 of the first armrest frame 10 by a bolt 59. A stretcher tube 57 is connected between the cross bars 17;27. The stretcher tube 57 has a first end connected to a swivel connector 571 at the second cross bar 27, and a second end connected to an adjustment connector 572 at the first cross bar 17. The second end of the stretcher tube 57 has a longitudinal series of transverse through holes for connection to the adjustment connector 572. By adjusting the connection between the longitudinal series of transverse through holes on the second end of the stretcher tube 57 and the adjustment connector 572, the distance between the contained angle defined within the first cross bar 17 and the second cross bar 27 is adjusted.

Two hand grips 52 are respectively mounted on the horizontal top tubes 15;25 of the armrest frames 10;20. A brake lever 53 is provided at one hand grip 52. A brake cable 535 is connected to the brake lever 53, and driven by the brake lever 53 to pull up a brake shoe 35 at each of the two rear wheel assemblies 30 to stop the wheeled triple-leg walker, or to reduce its movement speed. When taking a rest, the user can step on the lock 37 at each wheel assembly 30 to lock the wheels 36.

Referring to FIG. 2A, each wheel assembly 30 further comprises a constraint spring plate 395 coupled between the wheel holder 39 and the leg 31 to stop the wheel 36 from biasing. Therefore, the wheel holder 39 can be turned about the leg 31 to change the direction of the wheel 36 only when a downward pressure is applied to the constraint spring plate 395 through the leg 31.

The seat 40 is made from a trapezoidal plate, having hooks 417 and a locating pin 411. When not in use, the seat 40 is hung on the first armrest frame 10 by: hooking the hooks 417 in respective hook holes 174 on the first cross bar 17 and inserting the locating pin 411 in one locating slot 114 on the first downwardly extended vertical tube 11 of the first armrest frame 10.

Figure 3:
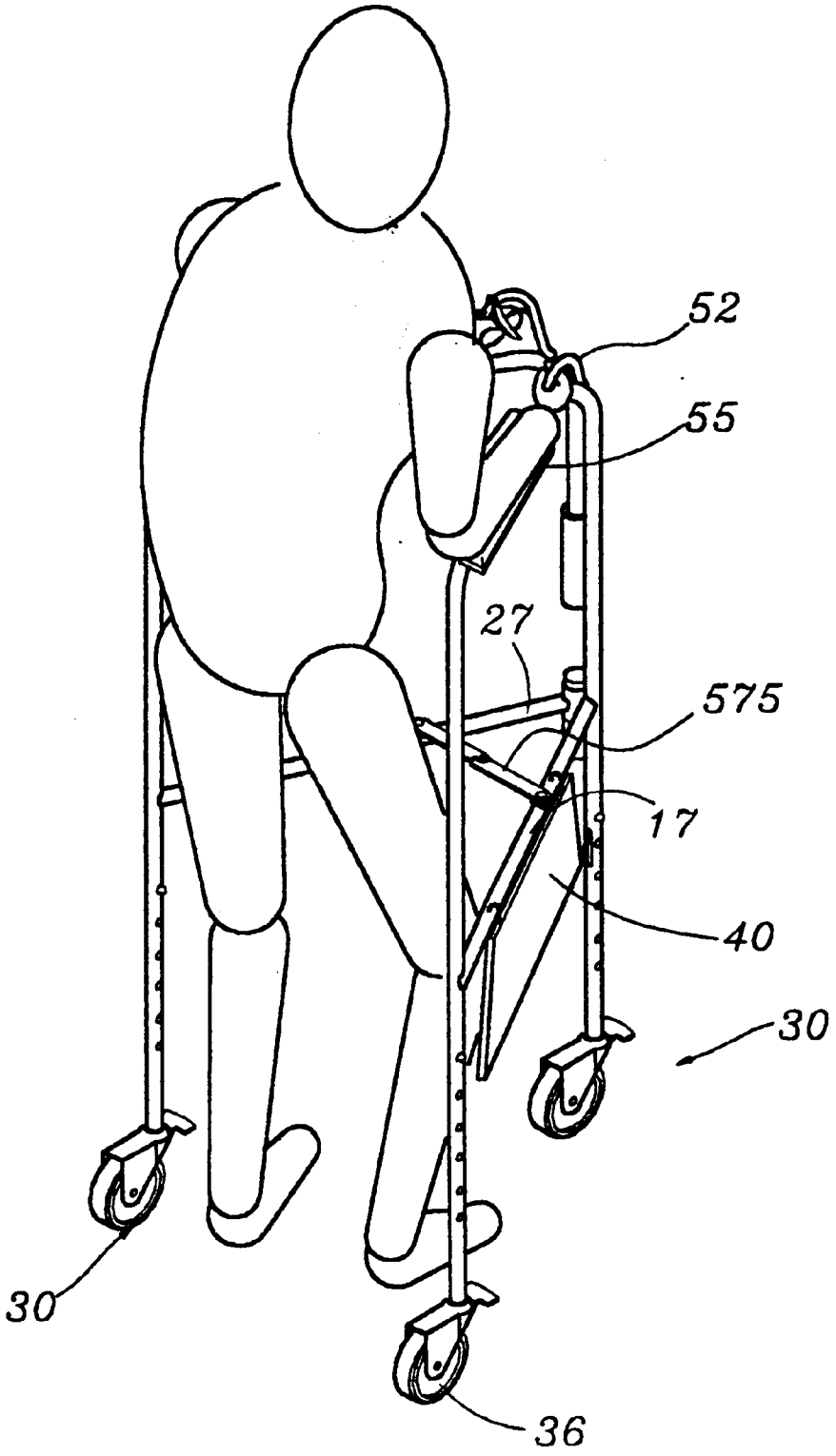
FIG. 3 is an applied view of the first embodiment of the present invention.

Referring to FIG. 3, when in use, the forearms are rested on the armrest pads 55 with the hands grasped on the hand grips 52, and the user can then move the wheeled triple-leg walker forwards when walking. Because the most pressure of the user lies on the armrest pads 55, the user can move the wheeled triple-leg walker comfortably with less effort.

Then, the stretcher tube 57 of the present invention is designed to a collapsible stretcher bar 575, the both ends of the collapsible stretcher bar 575 fastened to the first cross bar 17 and the second cross bar 27 respectively.

Figure 4:
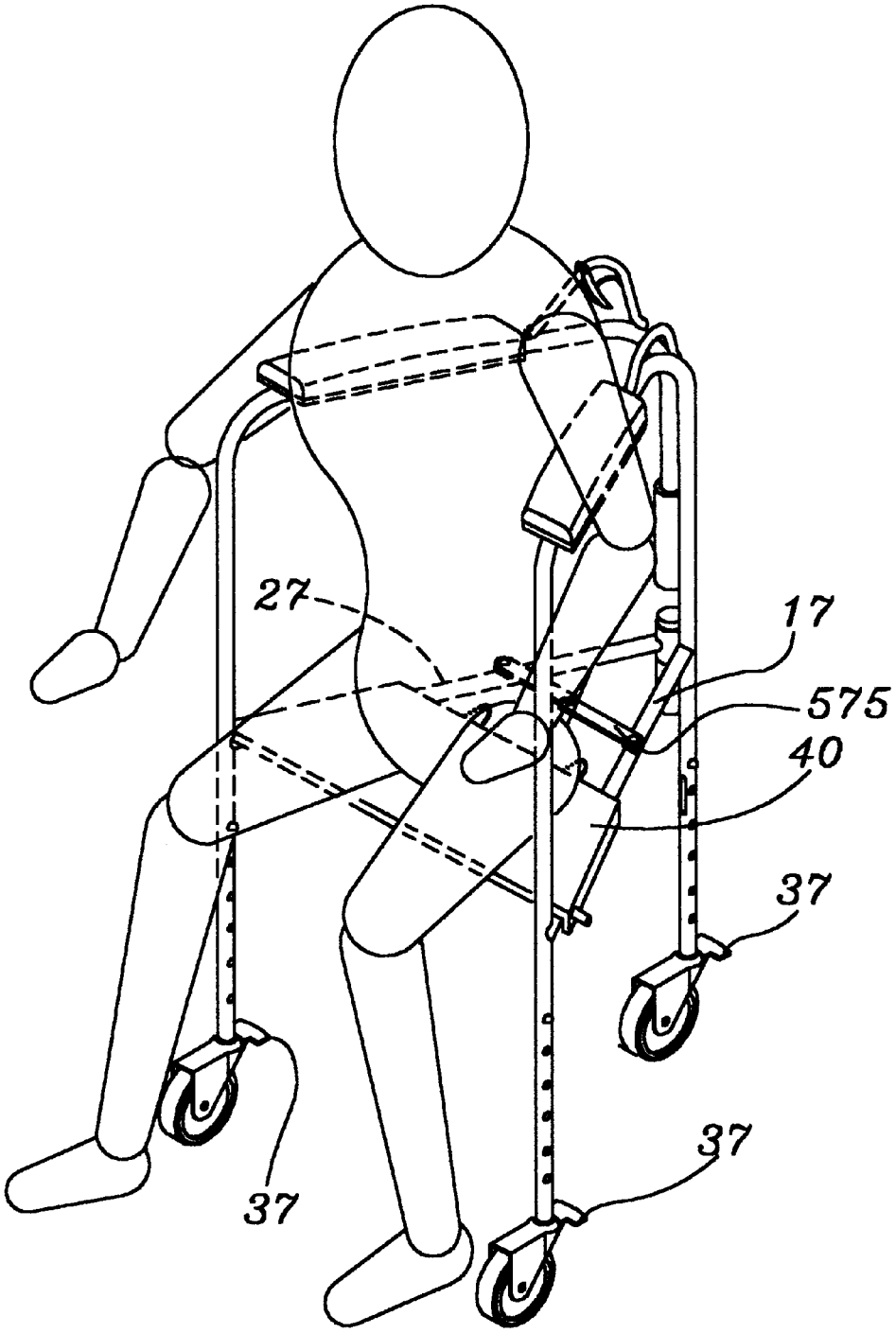
FIG. 4 is another applied view of the first embodiment of the present invention.

Referring to FIG. 4, when taking a rest, the lock 37 at each wheel assembly 30 is locked to stop the wheeled triple-leg walker from movement, then the seat 40 is disconnected from the hook holes 174 on the first cross bar 17 and the locating slot 114 on the first downwardly extended vertical tube 11 of the first armrest frame 10, and then the seat 40 is supported on the first cross bar 17 and the second cross bar 27 and secured in place for the user to sit thereon.

Figure 5:
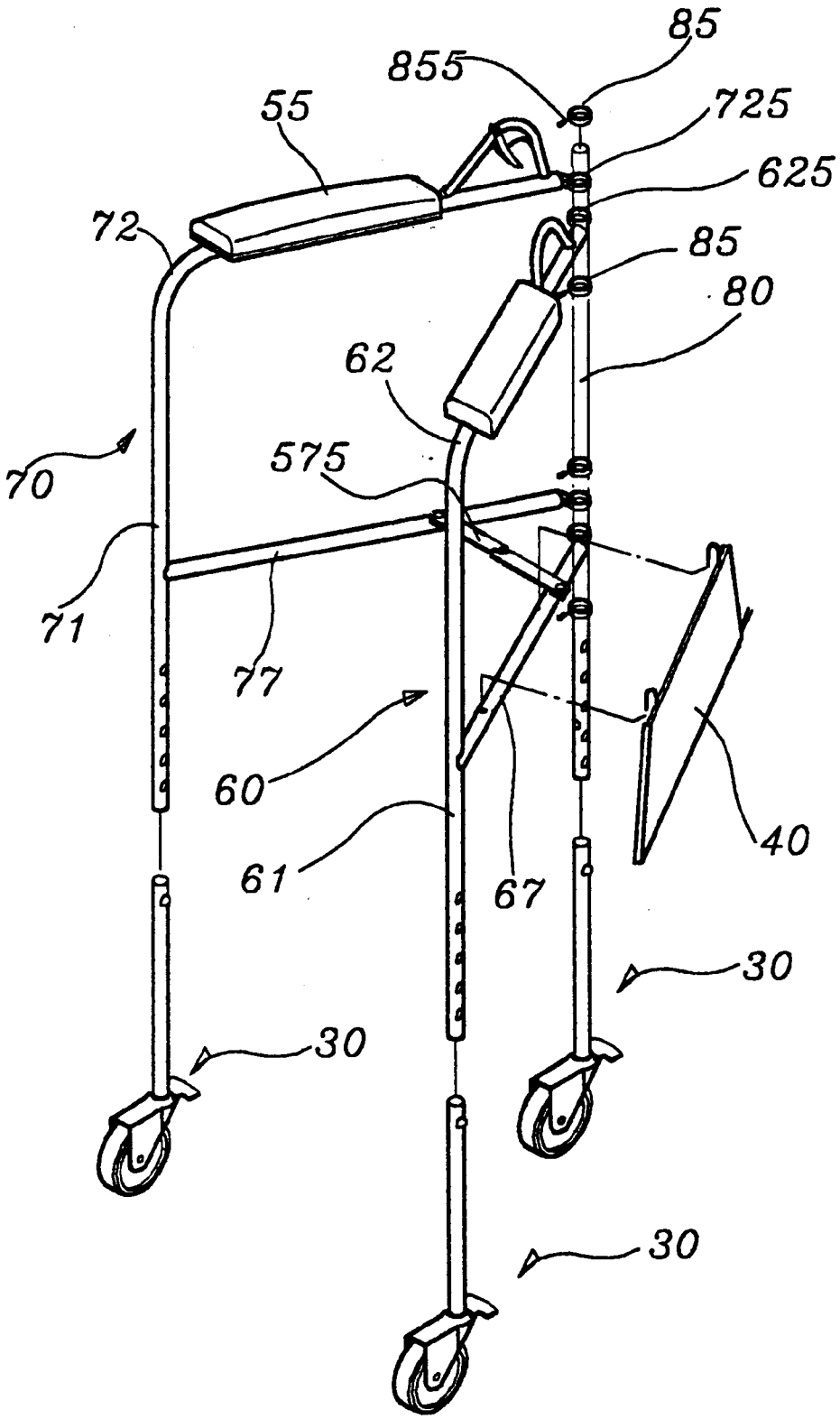
FIG. 5 is an exploded view of a wheeled triple-leg walker according to a second embodiment of the present invention.
Figure 5A:
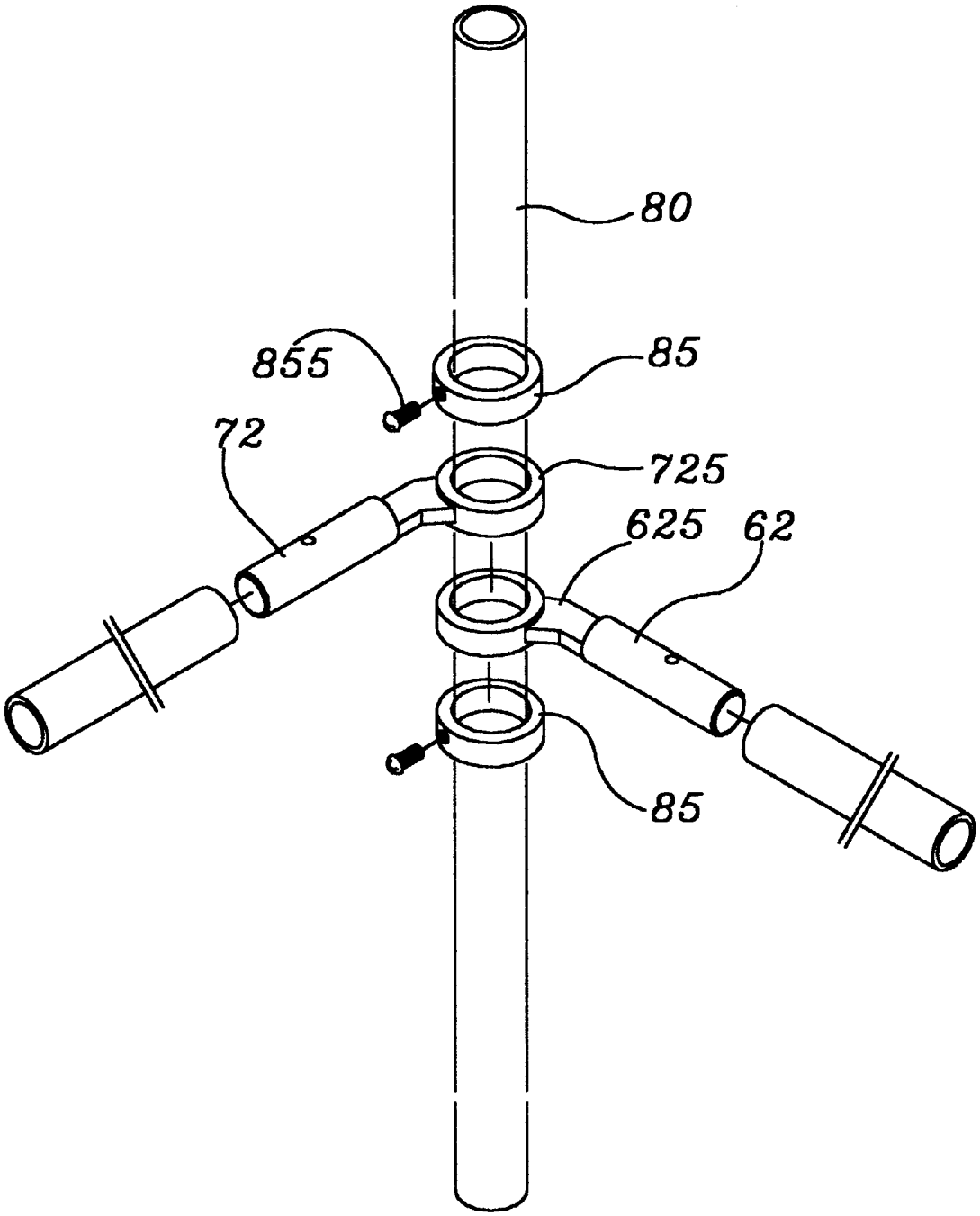
FIG. 5A is an enlarged view of a part of FIG. 5, showing the coupling rings and the locating rings mounted on the upright tube.

FIGS. 5 and 5A shows a wheeled triple-leg walker according to a second embodiment of the present invention. According to this embodiment, the wheeled triple-leg walker is comprised of a first F-shaped armrest frame 60, a second F-shaped armrest frame 70, an upright tube 80, three wheel assemblies 30, a seat 40, and two armrest pads 55. The first F-shaped armrest frame 60 comprises a vertical tube 61, and two horizontal tubes 62;67 respectively extended from the vertical tube 61 at different elevations . The second F-shaped armrest frame 70 comprises a vertical tube 71, and two horizontal tubes 72;77 respectively extended from the vertical tube 71 at different elevations. The horizontal tubes 62;67;72;77 each have a coupling ring 625;725 at one end respectively coupled to the upright tube 80. A plurality of locating rings 85 are mounted on the upright tube 80 and fixed to the upright tube 80 by respective tightening up screws 855 to support the coupling rings 625;725 at different elevations.

Figure 5B:
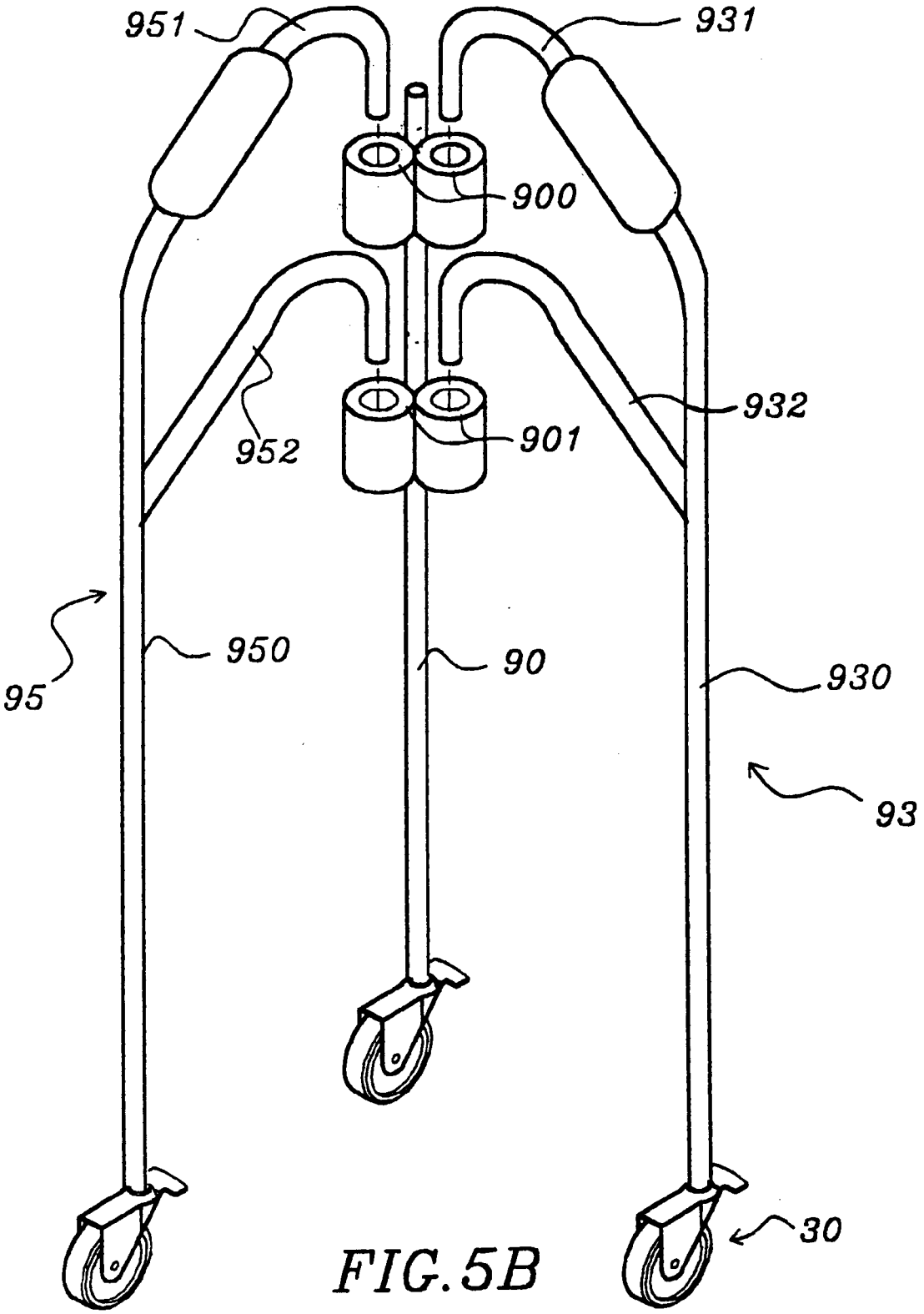
FIG. 5B shows the frame structure of a wheeled triple-leg walker according to a third embodiment of the present invention.

FIG. 5B shows a wheeled triple-leg walker according to a third embodiment of the present invention, in which a first armrest frame 93 is comprised of a vertical tube 930, and two hooked tubes 931;932 perpendicularly extended from the vertical tube 930 at different elevations; the second armrest frame 95 is comprised of a vertical tube 950, and two hooked tubes 951;952 perpendicularly extended from the vertical tube 950 at different elevations; the upright tube 90 has two vertically spaced pairs of barrels 900;901 which receive the hooked ends of the hooked tubes 931;932;951;952 respectively.

Figure 6:
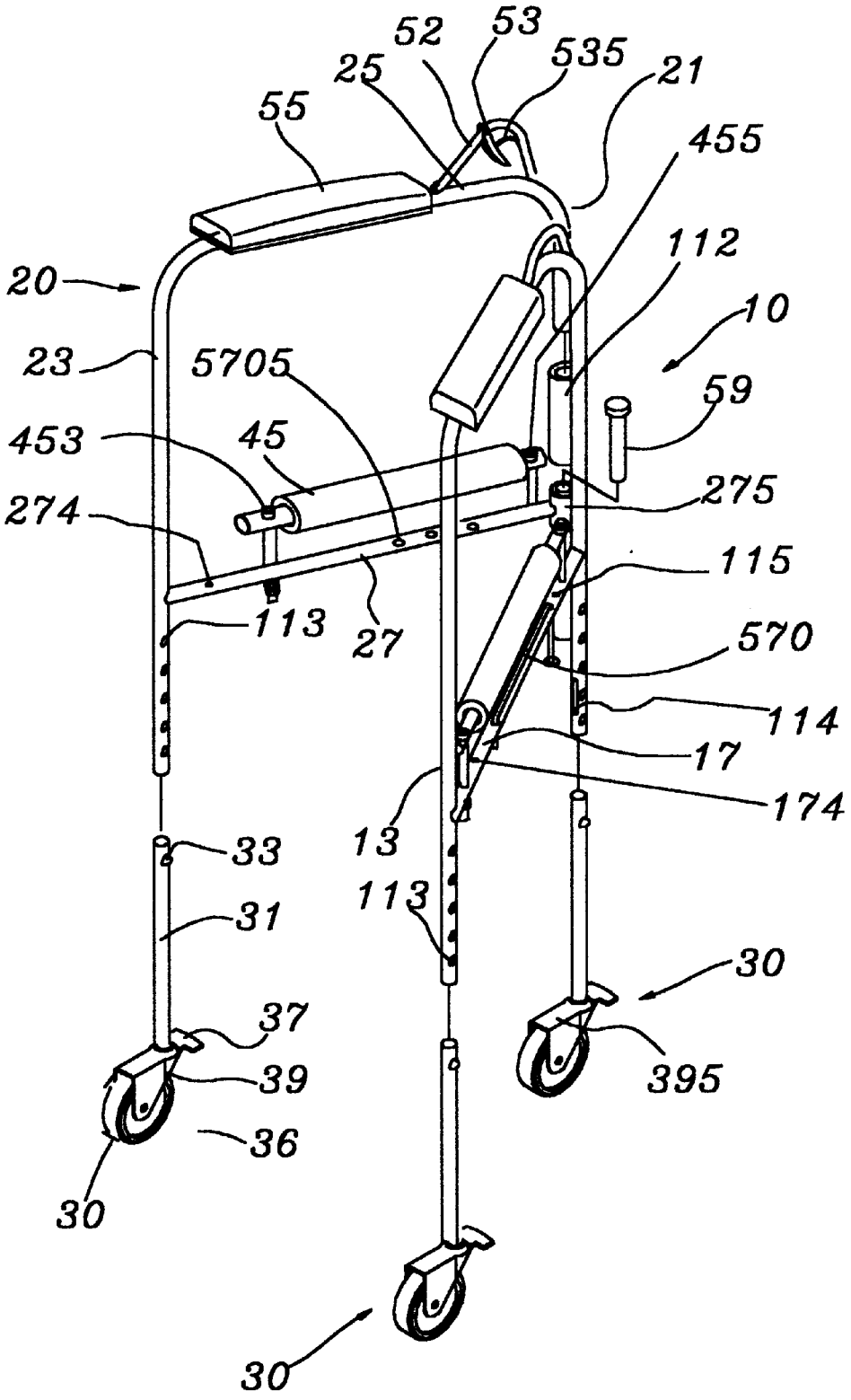
FIG. 6 is an exploded view of a wheeled triple-leg walker according to a fourth embodiment of the present invention.

FIG. 6 shows a wheeled triple-leg walker according to a fourth embodiment of the present invention, a stretcher bar 570 is provided for connection between the first cross bar 17 and the second cross bar 27. The stretcher bar 570 is a substantially U-shaped bar having a short vertical leg and a long vertical leg at both ends. The long vertical leg and the short vertical leg of the stretcher bar 570 are slidably inserted through a respective through hole (not shown) on the first cross bar 17. The long vertical leg of the stretcher bar 570, after insertion through the respective through hole on the first cross bar 17, is fastened with a nut, so that the stretcher bar 570 is secured to the first cross bar 17. When the stretcher bar 570 is lifted and the short vertical leg of the stretcher bar 570 is disconnected from the respective through hole on the first cross bar 17, the stretcher bar 570 is turned toward the second cross bar 27, enabling the short vertical leg of the stretcher bar 570 to be inserted into one of the longitudinally spaced locating holes 5705 on the second cross bar 27. By shifting the short vertical leg of the stretcher bar 570 from one locating hole 5705 to another, the distance between the contained angle defined within the first cross bar 17 and the second cross bar 27 is relatively adjusted.

Figure 7:
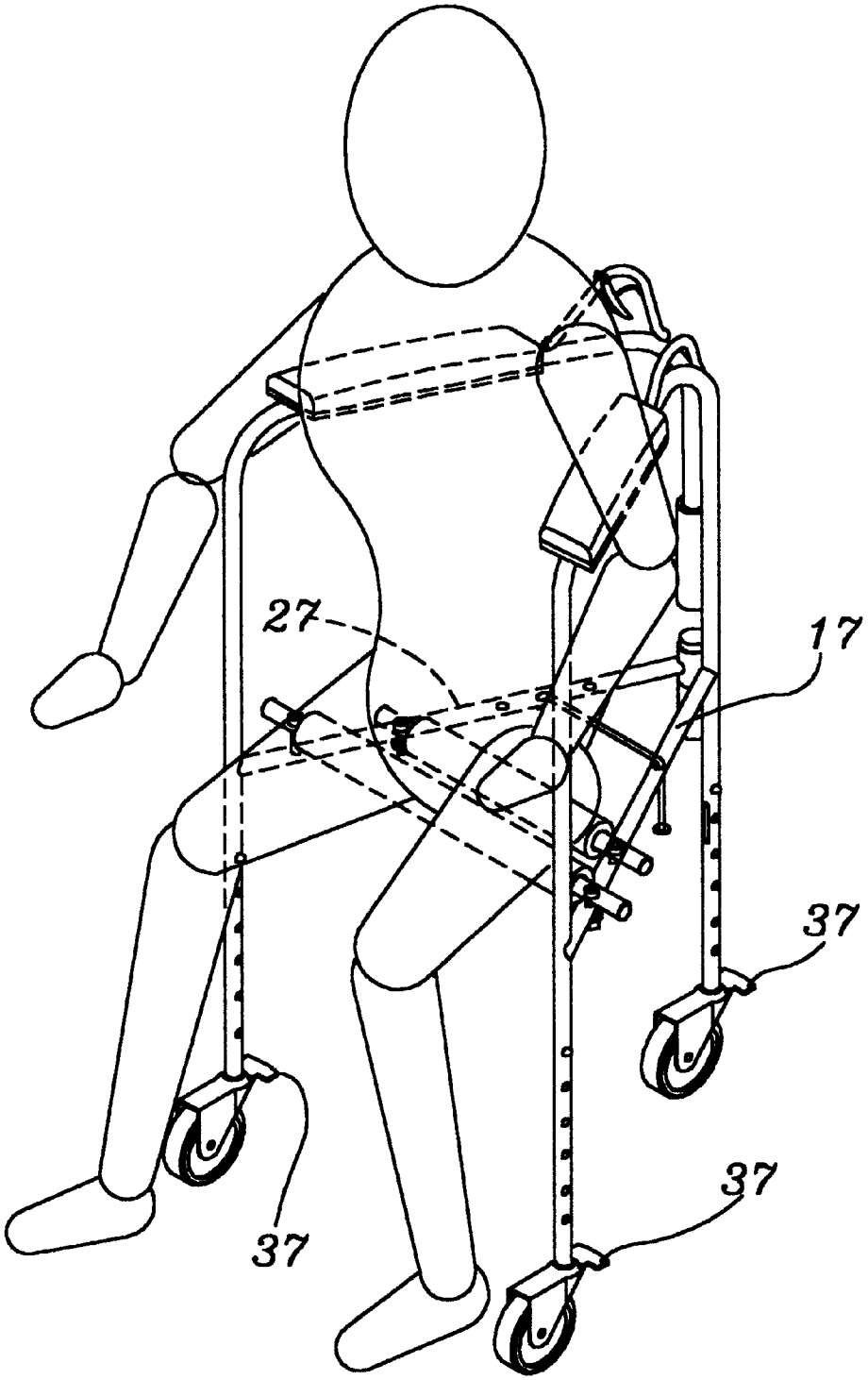
FIG. 7 is an applied view of the wheeled triple-leg walker according to the fourth embodiment of the present invention.

FIGS. 6 and 7 show a wheeled triple-leg walker according to a fourth embodiment of the present invention. According to this embodiment, two cylinders 45 are provided for connection between the first cross bar 17 and the second cross bar 27 to serve as seat means for the user to sit thereon. Each cylinder 45 has a fixed end pivotably connected to one cross bar 17 or 27 by a pivot 453 or 455, and a free end detachably fastened to one locating hole 274 or 174 on the other cross bar 27 or 17.

Figure 8:
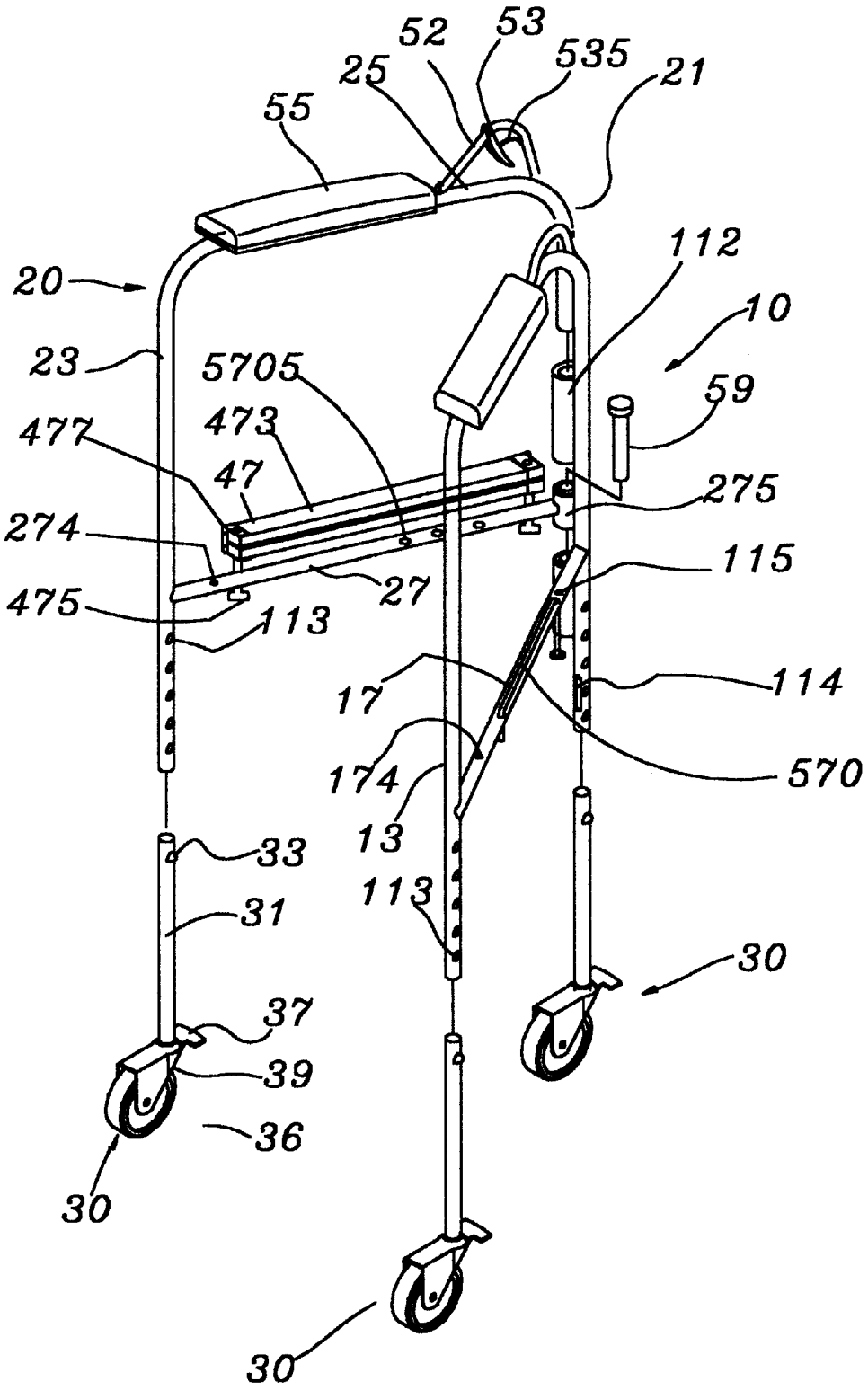
FIG. 8 is an exploded view of a wheeled triple-leg walker according to a fifth embodiment of the present invention.
Figure 9:
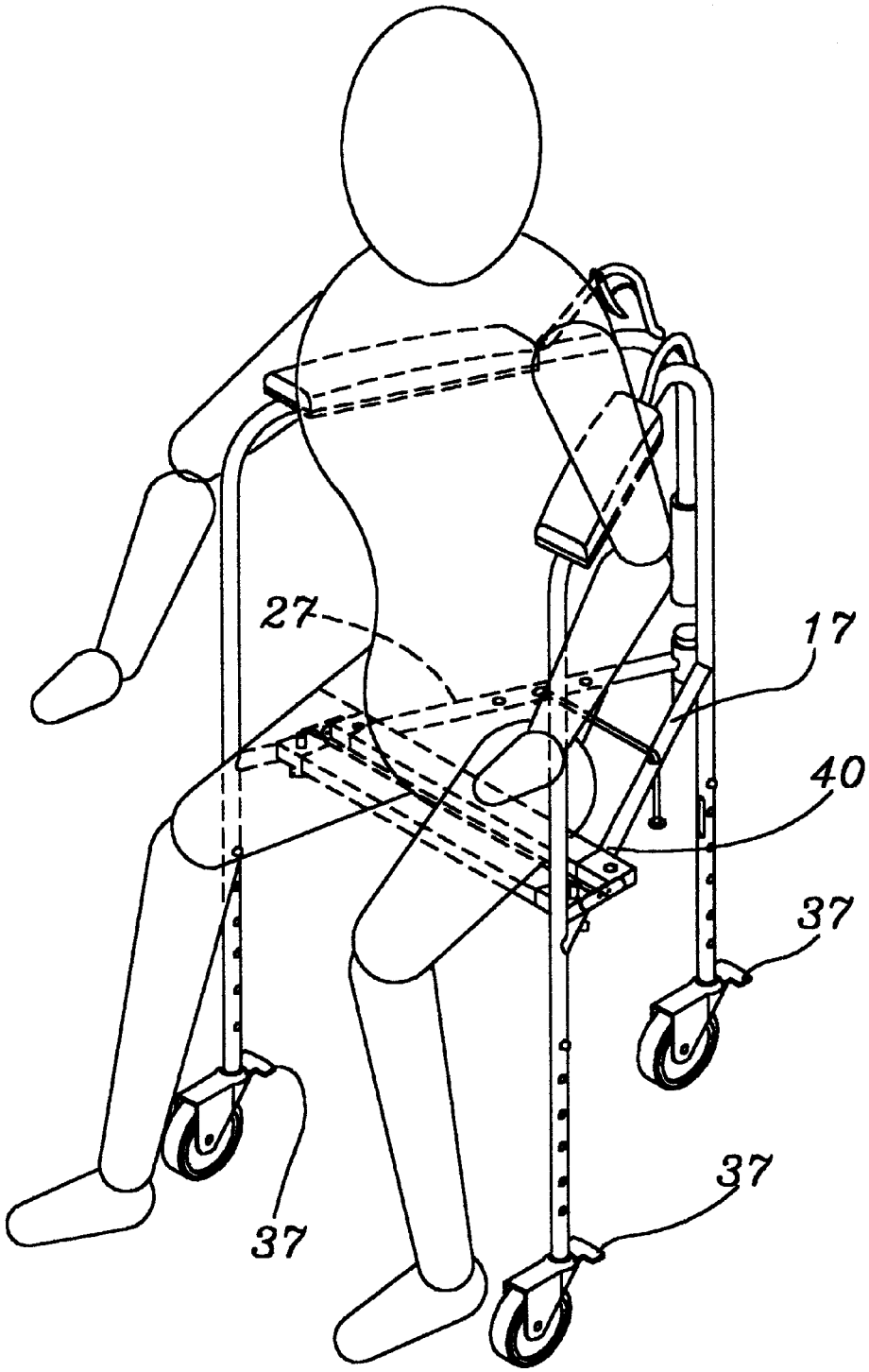
FIG. 9 is an applied view of the wheeled triple-leg walker according to the fifth embodiment of the present invention.

FIGS. 8 and 9 show a wheeled triple-leg walker according to a fifth embodiment of the present invention. According to this embodiment, two rectangular unit seats 47 are provided for connection between the cross bars 17;27. Each rectangular unit seats 47 is comprised of a rectangular seat plate 473, and two end blocks 477 at both ends of the rectangular seat plate 473. The end blocks 477 have a respective through hole (not shown) through which the rectangular unit seats 47 can be fastened in a stack to one cross bar 17 or 27 by screws 475, or supported between the cross bars 17;27 for the user to sit thereon.

It is to be understood that the drawings are designed for purposes of illustration only, and are not intended as a definition of the limits and scope of the invention disclosed.

What the invention claimed is:

1. A wheeled triple-leg walker comprising:

a first armrest frame, said first armrest frame comprising a horizontal top tube, a first downwardly extended vertical tube and a second downwardly extended vertical tube of equal length respectively integral with both ends of the horizontal top tube of said first armrest frame;

a second armrest frame coupled to said first armrest frame, said second armrest frame comprising a horizontal top tube, a short downwardly extended vertical tube and a long downwardly extended vertical tube respectively integral with both ends of the horizontal top tube of said second armrest frame, the short downwardly extended vertical tube of said second armrest frame being pivoted to the first downwardly extended vertical tube of said first armrest frame; and three wheel assemblies respectively mounted on the downwardly extended vertical tubes of said first armrest frame and the long downwardly extended vertical tube of said second armrest frame at a bottom side to support and move said wheeled triple-leg walker on the ground.

2. The wheeled triple-leg walker of claim 1, wherein the first downwardly extended vertical tube of said first armrest frame is fixedly mounted with a barrel which holds the short downwardly extended vertical tube of said second armrest frame.

3. The wheeled triple-leg walker of claim 1, wherein said first armrest frame comprises a cross bar connected between said first downwardly extended vertical tube and said second downwardly extended vertical tube and spaced below the horizontal top tube of said first armrest frame.

4. The wheeled triple-leg walker of claim 3, wherein said second armrest frame comprises a cross bar having a first end fixedly connected to said long downwardly extended vertical tube and a second end terminating in said barrel, said barrel at the cross bar of said second armrest frame being pivoted to a barrel at the first downwardly extended vertical tube of said first armrest frame by a bolt.

5. The wheeled triple-leg walker of claim 4 further comprising a stretcher bar connected between the cross bar on said first armrest frame and the cross bar on said second armrest frame.

6. The wheeled triple-leg walker of claim 1 further comprising two hand grips respectively mounted on the horizontal top tubes of said first armrest frame and said second armrest frame, and brake means controlled to stop the wheels of said wheel assemblies from rotation, said brake means comprising a brake lever mounted on one of said hand grips, a brake shoe mounted on each of said wheel assemblies and pulled up to stop the corresponding wheel from rotation, and a brake cable connected between said brake lever and the brake shoe at each of said wheel assemblies and driven by said brake lever to pull up the brake shoe on each of said wheel assemblies.

7. The wheeled triple-leg walker of claim 1 further comprising two armrest pads respectively mounted on the horizontal top tubes of said first armrest frame and said second armrest frame.

8. The wheeled triple-leg walker of claim 1, wherein said wheel assemblies each are comprised of a leg connected to one of said first armrest frame and said second armrest frame, a swivel wheel holder horizontally turned about said leg, a revolving wheel mounted on said swivel wheel holder, and a constraint spring plate coupled between said leg and said swivel wheel holder to stop said swivel wheel holder from turning about said leg, said swivel wheel holder being allowed to be turned about said leg when a downward pressure is applied to said constraint spring plate through said leg.

9. The wheeled triple-leg walker of claim 4 further comprising seat means for mounting on the cross bar of said armrest frame and the cross bar of said armrest frame for the user to sit thereon.

10. The wheeled triple-leg walker of claim 9, wherein said seat means comprises a trapezoidal seat plate, said trapezoidal seat plate having hook means and a locating pin, said trapezoidal seat plate being hung on the cross bar of said first armrest frame by hooking said hook means on hook holes on the cross bar of said first armrest frame and inserting said locating pin into a locating slot on the first downwardly extended vertical tube of said first armrest frame when said seat means is removed from the cross bars of said first armrest frame and said second armrest frame.

11. The wheeled triple-leg walker of claim 9, wherein said seat means comprises at least one cylindrical seat body, said cylindrical seat body having a first end pivoted to the cross bar of said second armrest frame, a second end, and a plurality of locating holes longitudinally arranged on said second end and connected to the cross bar of said first armrest frame by an adjustment screw means.

12. The wheeled triple-leg walker of claim 9, wherein said seat means comprises two rectangular unit seats, said rectangular unit seats each comprising a rectangular seat plate and two end blocks at both ends of the rectangular seat plate, said end blocks each having a through hole through which said rectangular unit seats can be arranged in a stack and fastened to the cross bar of one of said first armrest frame and said second armrest frame by screws, or arranged in parallel and fastened to the cross bars of said first armrest frame and said second armrest frame by screws for the user to sit thereon.

13. A wheeled triple-leg walker comprising:

an upright tube;

two F-shaped armrest frames, said F-shaped armrest frames each comprising a vertical tube, an upper horizontal tube and a lower horizontal tube respectively extended from said vertical tube at different elevations, said upper horizontal tube and said lower horizontal tube each having a coupling ring at one end respectively coupled to said upright tube;

a plurality of locating rings respectively mounted on said upright tube at different elevations and fixed therefor by a respective tightening up screw to support the coupling rings of the horizontal tubes of said F-shaped armrest frames on said upright tube at different elevations;

three wheel assemblies respectively mounted on the vertical tubes of said F-shaped armrest frames and said upright tube at a bottom side to support and move the wheeled triple-leg walker on the ground; and two armrest pads respectively mounted on the upper horizontal tubes of said F-shaped armrest frames at a top side.

14. The wheeled triple-leg walker of claim 13 further comprising a stretcher bar connected between the lower horizontal tubes of said F-shaped armrest frames, said stretcher bar having a first end pivoted to the lower horizontal tube of one of said F-shaped armrest frames, a second end, and a plurality of locating holes longitudinally arranged at said second end and connected to a locating hole on the lower horizontal tube of said F-shaped armrest frames.

15. The wheeled triple-leg walker of claim 13 further comprising two hand grips respectively mounted on the upper horizontal tubes of said F-shaped armrest frames, and brake means controlled to stop said wheel assemblies from movement, said brake means comprising a brake shoe provided at each of said wheel frames and pulled up to said wheel frames from movement, a brake lever mounted on said of said hand grip, and a brake cable connected between said brake lever and the brake shoe on each of said wheel frames.

16. The wheeled triple-leg walker of claim 13, wherein said wheel assemblies each are comprised of a leg connected to the vertical tube of one of said F-shaped armrest frames, a swivel wheel holder horizontally turned about said leg, a revolving wheel mounted on said swivel wheel holder, a constraint spring plate coupled between said leg and said swivel wheel holder to stop said swivel wheel holder from turning about said leg, and lock means to lock said revolving wheel, said swivel wheel holder being allowed to be turned about said leg when a downward pressure is applied to said constraint spring plate through said leg.

17. The wheeled triple-leg walker of claim 13 further comprising seat means for mounting on the lower horizontal tubes of said F-shaped armrest frames for the user to sit thereon.

18. The wheeled triple-leg walker of claim 17, wherein said seat means comprises a trapezoidal seat plate, said trapezoidal seat plate having hook means and a locating pin, said trapezoidal seat plate being hung on the lower horizontal tube of one of said F-shaped armrest frames by hooking said hook means on hook holes on the respective lower horizontal tube and inserting said locating pin into a locating slot on said upright tube when said seat means is removed from the lower horizontal tubes of said F-shaped armrest frames.

19. The wheeled triple-leg walker of claim 17, wherein said seat means comprises at least one cylindrical seat body, said cylindrical seat body having a first end pivoted to the lower horizontal tube of one of said F-shaped armrest frames, a second end, and a plurality of locating holes longitudinally arranged on said second end and connected to the lower horizontal tube of the other of said F-shaped armrest frames.

20. The wheeled triple-leg walker of claim 17, wherein said seat means comprises two rectangular unit seats, said rectangular unit seats each comprising a rectangular seat plate and two end blocks at both ends of the rectangular seat plate, said end blocks each having a through hole through which said rectangular unit seats can be arranged in a stack and fastened to the lower horizontal tube of one of said F-shaped armrest frames by screws, or arranged in parallel and fastened to the lower horizontal tubes of said F-shaped armrest frames by screws for the user to sit thereon.

21. A wheeled triple-leg walker comprising:

an upright tube, said upright tube having two vertically spaced pairs of barrels;

two armrest frames respectively pivoted to said upright tube, said armrest frames each comprising a vertical tube, and two hooked tubes perpendicularly extended from said vertical tube at different elevations and respectively hooked on the barrels on said upright tube;

three wheel assemblies respectively mounted on the vertical tubes of said armrest frames and said upright tube at a bottom side to support and move the wheeled triple-leg walker on the ground; and two armrest pads respectively mounted on the hooked tubes of said armrest frames at a top side.

* * * * *